US005338128A

United States Patent [19]

Blanco

[11] Patent Number: 5,338,128

[45] Date of Patent: Aug. 16, 1994

[54] DRYWALL JOINT FINISHING TOOL

[76] Inventor: Angel Blanco, 9008 Meadow Foam Ct., Elk Grove, Calif. 95758

[21] Appl. No.: 940,045

[22] Filed: Sep. 3, 1992

[51] Int. Cl.[5] ..... B05C 17/10; B25G 1/10

[52] U.S. Cl. ..... 403/206; 16/114 R; 15/145; 403/116

[58] Field of Search ..... 403/66, 206, 362, 83, 403/116, 164; 16/114 R; 15/143.1, 144.1, 145, 235.3, 235.4, 235.8; 156/575, 577, 71

[56] References Cited

U.S. PATENT DOCUMENTS

| | | | |
|---|---|---|---|
| D. 311,318 | 10/1990 | Ovens . | |
| 3,737,187 | 6/1973 | Pryor | 15/144.1 |
| 4,335,485 | 6/1982 | Paine et al. | 15/235.8 |
| 4,520,527 | 6/1985 | Maggio et al. | 15/235.8 |
| 4,592,797 | 6/1986 | Carlson | 156/574 |
| 4,663,796 | 5/1987 | Helling et al. | 15/144.2 |
| 4,782,632 | 11/1988 | Matechuk . | |
| 4,829,719 | 5/1989 | Braselton . | |
| 4,848,037 | 7/1989 | Happe . | |
| 4,848,818 | 7/1989 | Smith | 403/116 |
| 4,885,876 | 12/1989 | Henke . | |
| 5,088,147 | 2/1992 | MacMillan | 15/235.4 |
| 5,099,539 | 3/1992 | Forester | 15/145 |

*Primary Examiner*—P. Austin Bradley
*Assistant Examiner*—Erik R. Puknys
*Attorney, Agent, or Firm*—John P. O'Banion

[57] ABSTRACT

An apparatus (10) for adapting a drywall skim box (44) to an extension pole (16) to permit application of finishing compound to joints in locations remote from the user (54), such as in extended or high walls. The apparatus (10) includes a curved arm (24), one end of which is coupled to an extension pole (16) and the other end of which includes a mounting platform (38) for attachment to a skim box (44). The skim box (44) is both rotatably and pivotally coupled to the arm (24) for proper positing on a wall surface (58) to be finished. The geometrical relationship between the position of the skim box (44), the arm (24), and the extension pole (16) results in application of sufficient pressure to properly operate the skim box (44) as it is moved along a joint (56).

10 Claims, 4 Drawing Sheets

DRYWALL JOINT FINISHING TOOL

BACKGROUND OF THE INVENTION

1. Field of the Invention

This invention pertains generally to drywall joint finishing tools, and more particularly to an apparatus for mounting a drywall skim box to an extension pole.

2. Description of the Background Art

It is well known that, in order to achieve smooth seams in the areas where sheets of drywall are abutted, the joints must be taped and finishing compound or drywall mud must applied over the taped joints. The finishing compound is then sanded to provide a smooth finish for painting or texturing.

The application of finishing compound is typically accomplished by hand, or by using a "skim box" which is filled with finishing compound and attached to a handle or extension pole. The skim box, which includes a spring loaded finishing compound ejecting plate, is pressed against the drywall surface while is it moved along the joint in order to apply finishing compound in the area of the joint. The pressure applied to the skim box causes the finishing compound to be forced onto the drywall surface and into the joint.

In order to finish joints on extended or high walls, or in other areas which are difficult to reach, a ladder or scaffolding can be employed. However, safety, as well as the amount of time required to move from one location to another, makes the use of a ladder or scaffolding undesirable. Therefore, extension poles are used while the user stands on the floor.

Extension poles can be directly coupled to a skim box for finishing vertical field joints. However, there is no known device for adapting a skim box to an extension pole for finishing horizontal field joints. Direct coupling of the skim box to an extension pole for finishing horizontal filed joints does not yield satisfactory results. When working on extended or high walls, the angle between the wall and the extension pole can be so acute that it is not possible to apply sufficient pressure to the skim box to provide for satisfactory operation.

Therefore, a need exists for a device which can be attached to a skim box and an extension pole, and employed for applying sufficient pressure to the skim box for proper operation when finishing horizontal field joints on extended or high walls. The present invention fills that need and overcomes the deficiencies exhibited by conventional drywall finishing tools and devices.

SUMMARY OF THE INVENTION

By way of example and not of limitation, the present invention generally comprises a uniquely configured adaptor for mounting a drywall finishing "skim box" to an extension pole or other support member, and includes a curved arm which is disposed between the skim box and the extension pole. One end of the arm includes a receptacle into which an extension pole can be inserted and locked into place. The other end of the arm includes a mounting plate which can be pivoted or rotated in relation to the arm. A locking mechanism is provided so that the mounting plate can be rotated through a range of approximately 180 degrees and then locked into position. The mounting platform pivots freely, and is limited only by its range of motion. A plurality of slots on the mounting platform mate with corresponding studs on the skim box for attachment thereto.

The curved arm extends through an arc of approximately 90 degrees and, therefore, the ends of the arm are displaced by approximately 90 degrees in relation to each other. The receptacle at the proximal end of the arm is offset by approximately 45 degrees in relation to the proximal and distal ends of the arm. Therefore, when a skim box attached to the apparatus is placed against a vertical wall, the angle between the surface of the wall and the extension pole will be approximately 45 degrees plus or minus the pivotal range of mounting plate. This angular relationship, as well as the curvature of the arm, results in an efficient transfer of pressure from the extension pole to the skim box.

An object of the invention is to provide for use of a drywall skim box with an extension pole or other support member.

Another object of the invention is to provide for application of sufficient pressure to a skim box for proper operation from an extension pole or other support member.

Another object of the invention is to provide for finishing drywall joints with a skim box on extended or high walls.

Another object of the invention is to provide access to hard to reach drywall joints for applying finishing compound with a skim box.

Another object of the invention is to apply finishing compound to drywall joints without the use of a ladder or scaffolding.

Another object of the invention is to provide for finishing horizontal field joints on extended or high walls.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which are for illustrative purposes only.

DESCRIPTION OF THE PREFERRED EMBODIMENTS

Figure 1:
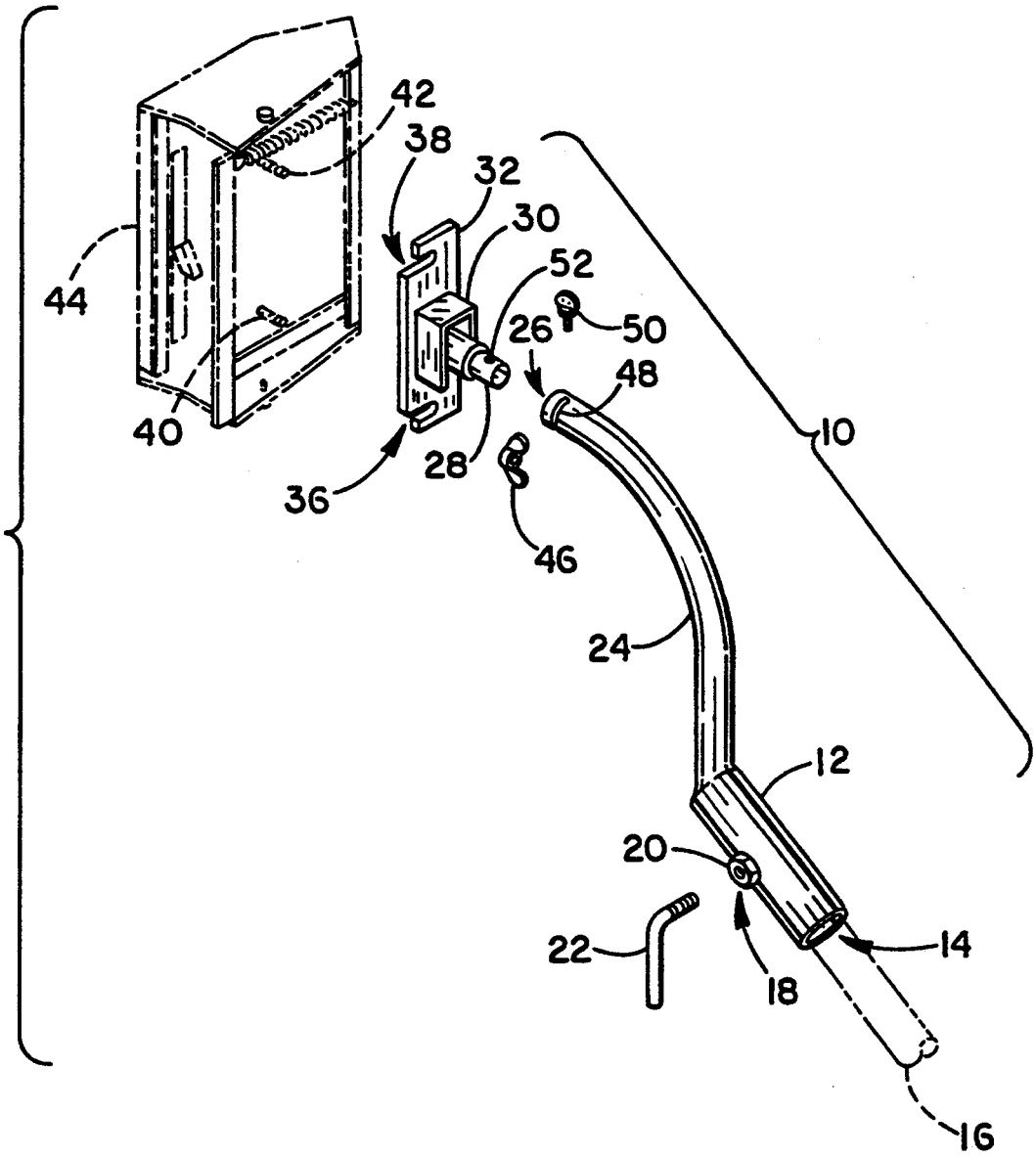
FIG. 1 is an exploded view of the apparatus of the present invention and shows the relationship of the apparatus to a drywall finishing skim box and extension pole shown in phantom.
Figure 2:
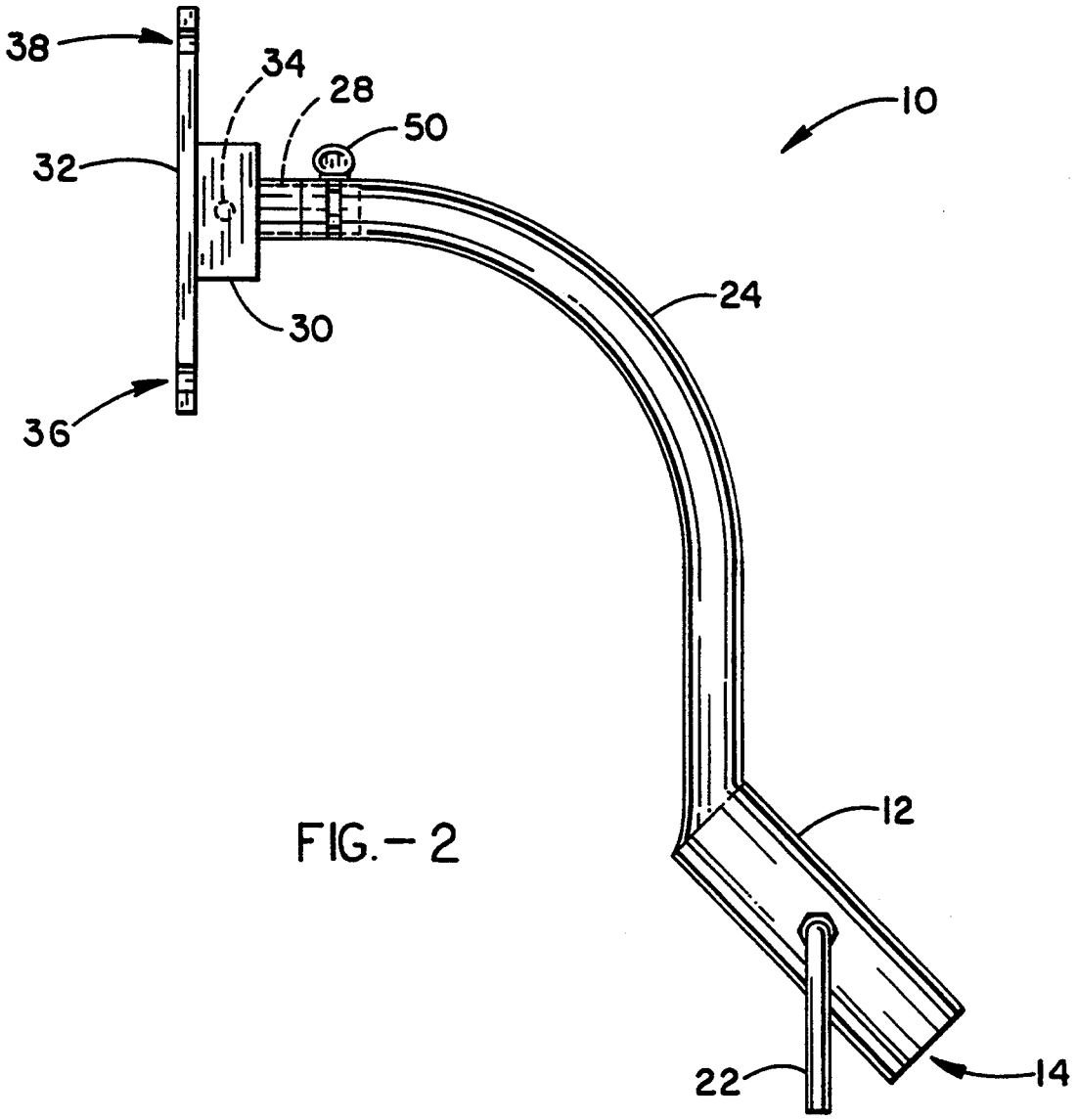
FIG. 2 is a side elevation view of the apparatus of the apparatus of the present invention.
Figure 4:
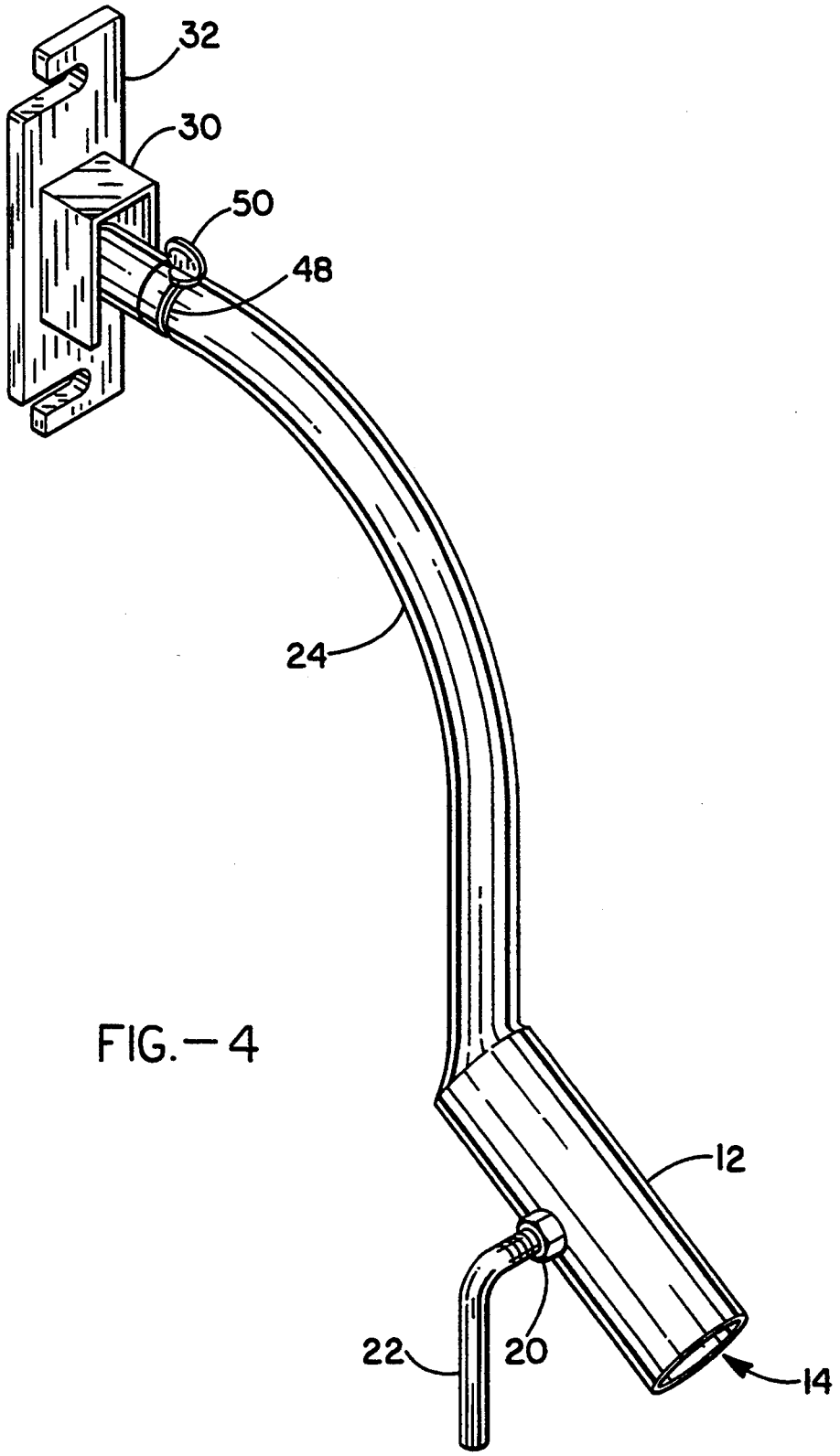
FIG. 4 is a perspective view of the apparatus of the present invention.

Referring more specifically to the drawings, for illustrative purposes the present invention is embodied in the apparatus which is generally shown in FIG. 1, FIG. 2, and FIG. 4. It will be appreciated that the apparatus may vary as to configuration and as to details of the parts without departing from the basic concepts as disclosed herein.

FIG. 1 is an exploded view showing a skim box adapter 10 according to the present invention. While lightweight aluminum is preferred, the apparatus can be fabricated from other rigid, lightweight materials such as magnesium, high impact plastic, wood, or the like.

Referring also to FIG. 2 and FIG. 4, the apparatus of the present invention includes a generally tubular shank 12 which includes a receptacle 14 into which an extension pole 16 or other support member can be inserted and interconnected. An opening 18 extends through the wall of shank 12. A threaded nut 20 is welded or otherwise rigidly affixed to shank 12 over opening 18. A threaded key 22 extends into nut 20 and through opening 18 to lock extension pole 16 to shank 12.

Extending from shank 12 is a curved arm 24 having a radius of curvature of approximately 90 degrees. In the preferred embodiment, the distal end of arm 24 is offset from shank 12 by approximately 45 degrees, although other offsets could be employed. In addition, it is preferred that arm 24 be of a tubular configuration so that apparatus is lightweight. Those skilled in the art will appreciate that arm 24 could alternatively be of solid construction.

The distal end of arm 24 includes a receptacle 26 into which a shaft 28 is inserted. Shaft 28 is pivotally coupled to a bracket 30 which is affixed to a plate 32. A pin 34 extends through bracket 30 and shaft 28 to provide said pivotal coupling. Bracket 30 is of a rectangular box-shaped configuration as shown, the upper and lower walls of which act as stops to limit the range through which shaft 28 can pivot. Plate 32 includes a pair of slots 36, 38 which are configured to mate with corresponding studs 40, 42 on the base of a conventional skim box 44. A wing nut 46 is used to secure each stud to plate 32.

The distal end of arm 24 also includes a slotted channel 48 which extends circumferentially around approximately one-half of receptacle 26. A thumb screw 50 extends through channel 48 and into a threaded hole 52 in shaft 28, thereby securing shaft 28 to arm 24. This configuration provides for rotation of plate 32 (as well as skim box 44) through a range of approximately 180 degrees.

Figure 3:
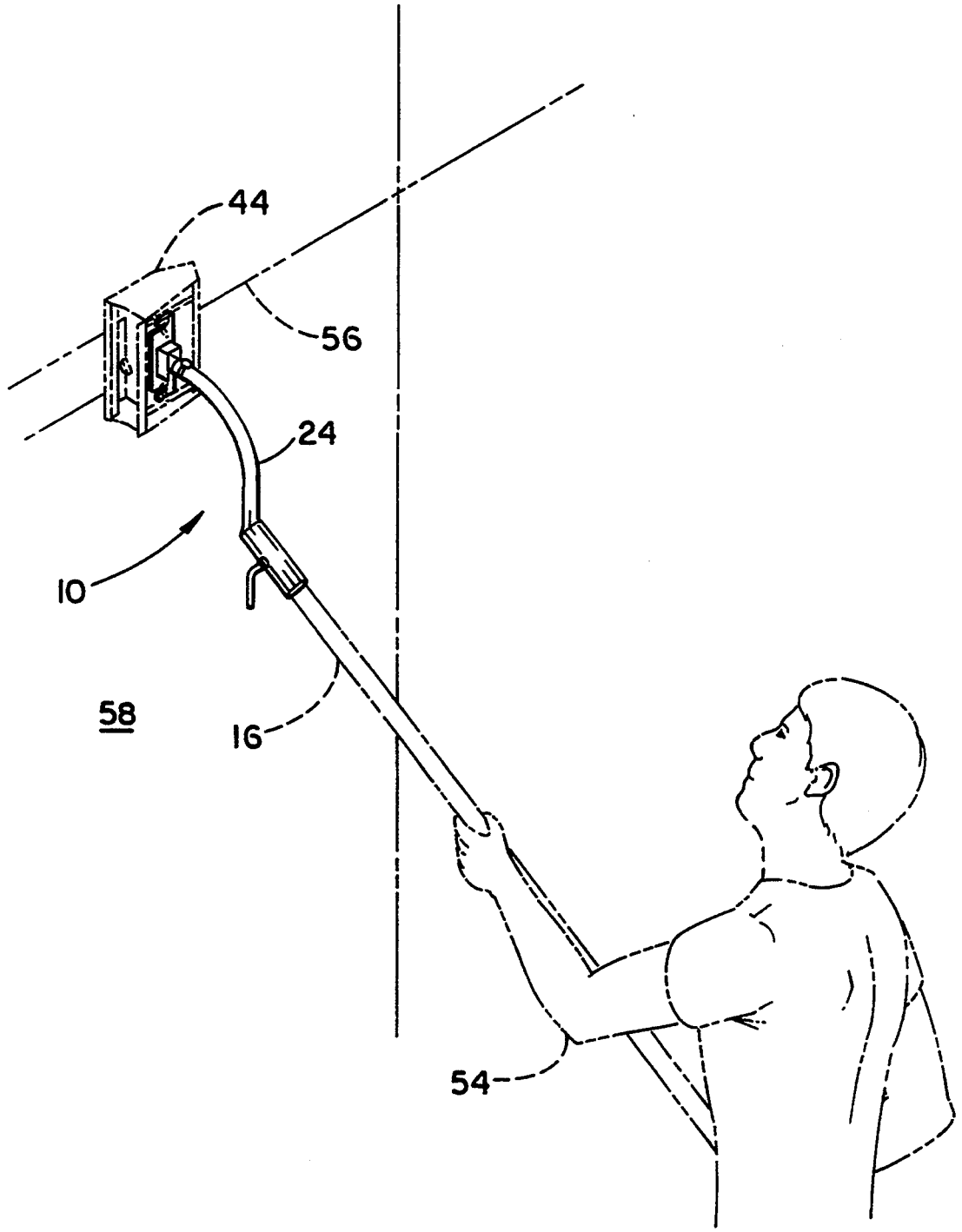
FIG. 3 is a perspective view of the apparatus of the present invention attached to a skim box and extension pole shown in phantom and shows the present invention in its context of use.

Referring now to FIG. 3, the apparatus permits a user 54 to position and move skim box 44 along a horizontal joint 56 by means of an extension pole 16. Pressure applied axially to extension pole 16 is transferred through arm 24 and to skim box 44. Since skim box 44 can also pivot vertically in relation to arm 24, skim box 44 can be positioned flat against the surface of wall 58 for proper application of finishing compound. In this manner, the user 54 can apply sufficient pressure to skim box 44 for proper operation as it is moved along horizontal joint 56. Note also that a conventional skim box is configured for movement along a joint in a particular lateral direction (e.g., left to right or right to left). By rotating skim box 44 by approximately 180 degrees in relation to arm 24, the user can quickly accommodate a change in the direction of which skim box 44 is laterally moved along joint 56.

Accordingly, it will be seen that the present invention provides a useful and effective apparatus for adapting a drywall skim box to an extension pole for finishing joints in areas which are difficult to reach, and overcomes the deficiencies in conventional drywall finishing tools and devices. Although the description above contains many specificities, these should not be construed as limiting the scope of the invention but as merely providing illustrations of some of the presently preferred embodiments of this invention. Thus the scope of this invention should be determined by the appended claims and their legal equivalents.

I claim:

1. A drywall finishing tool, comprising:

(a) a plate, said plate including means for coupling to a drywall skim box;

(b) a shank, said shank including means for coupling to a support member;

(c) a curved arm, said arm pivotally coupled to said plate at a first end, said arm extending from said shank at a second end, said arm being angularly offset from said shank at said second end.

2. A drywall finishing tool as recited in claim 1, wherein said arm extends through an arc of approximately 90 degrees and said arm is offset from said shank by approximately 45 degrees.

3. A drywall finishing tool as recited in claim 2, wherein said plate is rotatably coupled to said arm.

4. A drywall finishing tool as recited in claim 1, further comprising a support member coupled to said shank.

5. An apparatus for mounting a drywall skim box to a hand held support member, comprising:

(a) a first shank, said first shank including first and second ends, said first shank including a receptacle at said first end for coupling said first shank to a support member;

(b) an arcuate arm, said arm extending from said second end of said first shank, said arm including an end distal to said first shank; and (c) a plate, said plate pivotally coupled to a second shank, said second shank rotatably coupled to said distal end of said arm, said arm having a radius of curvature of approximately 90 degrees, said first shank being offset from said arm by an angle of approximately 45 degrees.

6. An apparatus as recited in claim 5, further comprising means for fixing the position of said second shank in relation to said arm.

7. An apparatus as recited in claim 5, further comprising means for locking a support member to said first shank.

8. An apparatus as recited in claim 5, further comprising a support member coupled to said first shank.

9. An apparatus for interconnecting a drywall joint compound application device to a support member such as a pole or handle, comprising:

(a) a base plate, said base plate including a plurality of slots;

(b) a bracket, said bracket joined to said base plate;

(c) a shank, said shank pivotally coupled to said bracket;

(d) a curved arm, said arm extending in an arc of approximately 90 degrees, said arm including a distal end and a proximal end, said distal end of said arm rotatably coupled to said shank; and (e) an interconnecting member, said interconnecting member extending from said proximal end of said arm, said interconnecting member including a receptacle configured and structured for attachment to a support member, said interconnecting member being offset from said proximal end of said arm by approximately 45 degrees.

10. An apparatus as recited in claim 9, further comprising a support member attached to said receptacle.

* * * * *